US006366205B1

(12) United States Patent
Sutphen

(10) Patent No.: US 6,366,205 B1
(45) Date of Patent: Apr. 2, 2002

(54) SYSTEM FOR DETECTING MISSING GOLF CLUBS

(75) Inventor: Robert L. Sutphen, Aberdeen, NC (US)

(73) Assignee: Club Keeper International, Inc., Aberdeen, NC (US)

( * ) Notice: Subject to any disclaimer, the term of this patent is extended or adjusted under 35 U.S.C. 154(b) by 0 days.

(21) Appl. No.: 09/649,460

(22) Filed: Aug. 25, 2000

(51) Int. Cl.[7] ..... G08B 13/14

(52) U.S. Cl. ..... 340/568.6; 340/568.1; 340/572.1

(58) Field of Search ..... 340/568.6, 568.1, 340/572.1, 572.8, 686, 687

(56) References Cited

U.S. PATENT DOCUMENTS 5,565,845 A * 10/1996 Hara ..... 340/568.1
6,023,225 A * 2/2000 Boley et al. ..... 340/568.6
6,057,762 A * 5/2000 Dusza ..... 340/568.6
6,118,376 A * 9/2000 Regester ..... 340/568.6

* cited by examiner

*Primary Examiner*—Daryl Pope
(74) *Attorney, Agent, or Firm*—Coats & Bennett, P.L.L.C.

(57) ABSTRACT

A device is provided for determining if one or more golf clubs are missing from a group of golf clubs. The device includes a transmitter or transceiver, that is, operative to direct a signal towards a group of golf clubs where each golf club is provided with a sensor tag. The signal from the transmitter registers with the respective sensor tags and in response thereto each sensor tag emits a response signal that is uniquely associated with the sensor tag and the golf club associated with the sensor tag. This response signal is directed back to the transceiver and the transceiver is in return coupled to a controller that receives information or data from the transceiver that identifies the detected golf clubs of the group. Based on the golf clubs detected, the controller can determine if one or more golf clubs are missing from the group.

18 Claims, 4 Drawing Sheets

SYSTEM FOR DETECTING MISSING GOLF CLUBS

FIELD OF THE INVENTION

The present invention relates to golf accessories and more particularly to a device for detecting a missing golf club within a golf bag.

BACKGROUND OF THE INVENTION

Almost every golfer has experienced the loss of a golf club on a golf course. This most frequently happens when a golfer retrieves two or more clubs from his or her bag and takes the club to the site of the ball and in the course of making the shot simply drops the one or two clubs not being used in an area adjacent to the site of the ball. After making the shot, the golfer inadvertently forgets about the unused clubs and moves to the next shot. This, of course, means that the golfer has left behind one or more clubs.

It is true that in many cases, within the same round, the golfer will realize that one or more clubs are missing from his or her bag. When that is realized, the golfer will backtrack and search for the lost club or clubs. Many times this in itself can be a difficult task because the golfer does not recall where the lost clubs where left. In short it can become a time-consuming and frustrating endeavor. This is especially a problem when the golf course is crowded and there is a pressure to maintain a fairly rapid pace of play.

Unfortunately, many golf clubs that are inadvertently left on the fairway or around the green are discovered by others and are not returned to the owner or to the clubhouse. These clubs are lost forever and with the cost of golf clubs being what they are today, that is no small loss.

Therefore, there has been and continues to be a need for a device or system that will continue to monitor a golfer's bag and determine if any one of a set of golf clubs is missing, and if so to appraise the golfer of that fact.

SUMMARY OF THE INVENTION

The present invention relates to a device that monitors the number of golf clubs in a golf bag. More particularly, based on a certain number of clubs constituting a set or forming a group of clubs within the golf bag, the device functions to identify or detect each golf club of the set or group. If the device is unable to detect one or more clubs of the set or group, then it sounds an alarm, either audible or visual, appraising the golfer that the set or group is not complete or missing at least one club.

In one embodiment, the device comprises a transceiver that is operatively connected to a controller. Further, there is provided a series of sensors or sensor tags, with each sensor tag having a unique identify and secured to one golf club of the group. The device, through the transceiver, emits one or more signals aimed at registering with the sensor tags associated with the golf clubs. In one particular embodiment, a single signal is emitted and the single signal is adapted to register with each sensor tag. Upon registration with the sensor tag, the sensor tag itself emits a responsive signal that uniquely identifies that sensor tag and its associated golf club. That responsive signal is directed back to the transceiver where the data associated with the responsive signal is directed to the controller. There the controller compares the responsive signals with a stored list of inventory clubs and is able to determine if one or more of the set or group of clubs of the inventory is missing.

In another embodiment, the transceiver may direct a series of signals, with each signal being uniquely coded to register with only one sensor tag. In this case, the registration with a sensor tag spurs a responsive signal from the sensor tag that is transmitted back to the transceiver. This responsive signal also uniquely identifies the sensor tag and its associated golf club.

In another embodiment of the present invention, the controller is programmed to conduct an inventory of clubs during an initialization step. That is, the controller is operative to scan the entire set or group of clubs and determine which clubs are in the group or set. This inventory of clubs is then stored in memory. Thereafter, in detecting for a missing club, the controller is operative to search or monitor for each club of the inventoried list. If the device is unable to detect each club of the inventoried list, then the device appraises the golfer that there is one or more missing clubs from the inventoried list.

Other objects and advantages of the present invention will become apparent and obvious from a study of the following description and the accompanying drawings which are merely illustrative of such invention.

DETAILED DESCRIPTION OF THE DRAWINGS

Figure 1:
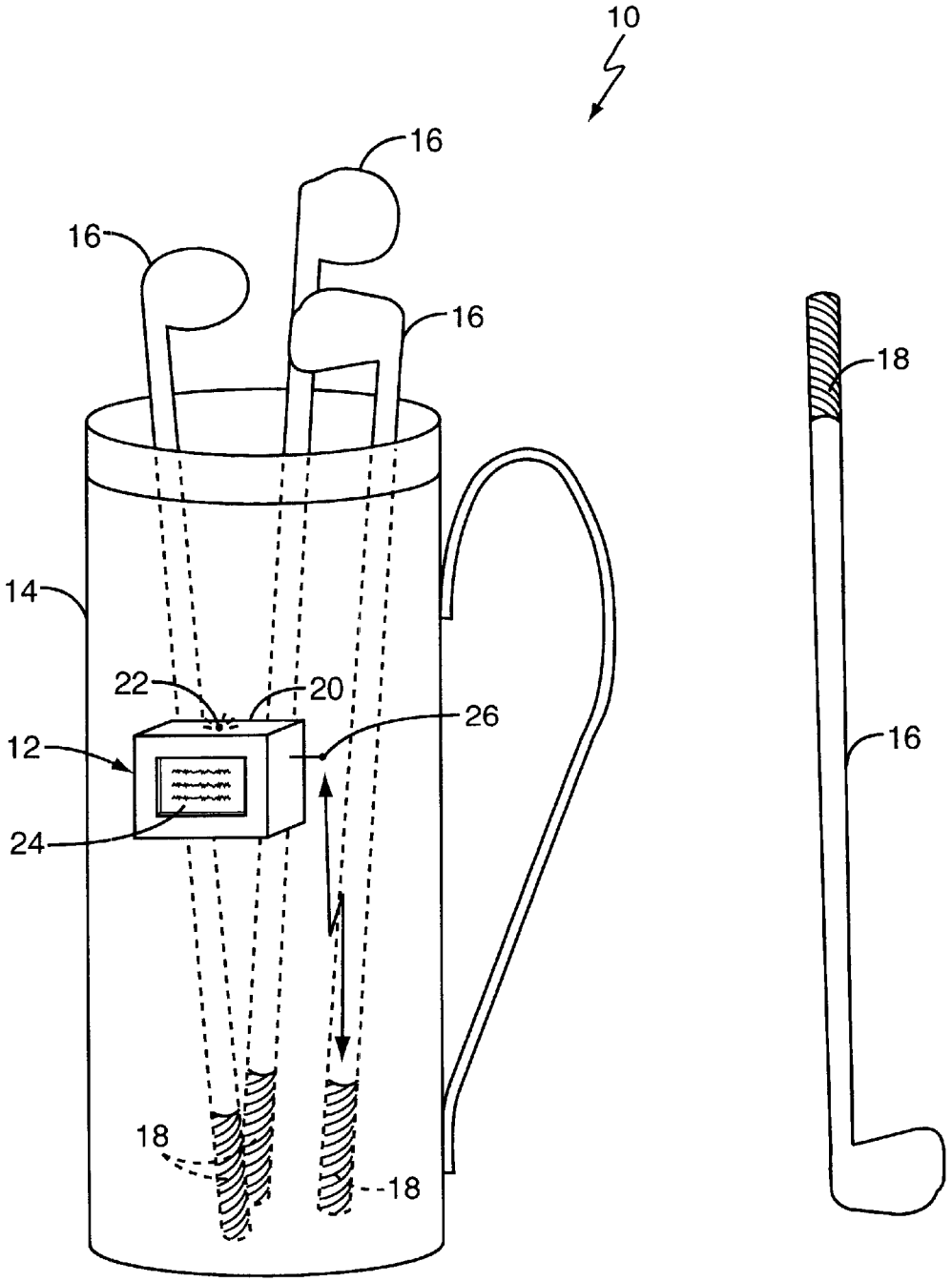
FIG. 1 is a prospective view of a golf bag showing the golf club monitoring device of the present invention mounted on a golf bag.

The present invention entails a system for monitoring a set or group of golf clubs that are held within a golf bag or otherwise grouped together. The system is designed to detect one or more missing clubs from the group or set, and upon detection to appraise the golfer if one or more golf clubs from the group or set are in fact missing. As will be appreciated from subsequent portions of this disclosure, the system relies on sensors or sensor tags secured to the respective golf clubs of the group or set. By sending out a signal or a group of signals, the sensor tags and the associated golf clubs can be identified and accounted for. Through appropriate logic, the system of the present invention is able to maintain an inventory or list of the golf clubs that make up the set or group. The identified golf clubs can be compared or matched against the inventoried list and from that the system can determine if one or more of the clubs is missing. Once it is determined that one or more clubs is missing, then by actuating an alarm, the system can appraise the golfer of the fact of a missing golf club. FIG. 1 depicts the golf club monitoring system according to the present invention, indicated generally at 10. The golf club monitoring system comprises an interrogator or control unit indicated generally by the numeral 12. Control unit 12 is typically mounted on or in close proximity to a golf bag 14. Each golf club 16 is provided with a radiofrequency identification tag (RFID) 18 affixed to the handle thereof. It should be appreciated that the RFID tags can be secured at other locations on the golf club such as near the golf club head. The RFID tags 18 affixed to golf clubs 16 contained within or proximate to golf bag 14 are adapted to be in radiofrequency (RF) communication with control unit 12. As will be appreciated from subsequent portions of the disclosure, the control unit 12 is designed to have a limited range. That is, once the golf clubs and RFID tags 18 are outside of a selected range, the control unit 12 is ineffective to communicate with the respective RFID tags 18.

Control unit 12 includes a housing 20, a visual indicator 22 such as a light bulb, LED, or other light source, a display 24, and an antenna 26. The visual indicator 22 illuminates, either steadily or flashing, to indicate that one or more golf clubs 16 are missing from golf bag 14.

In addition, the control unit 12 may include a audible alarm that is selectively actuated when one or more golf clubs are missing from a certain set or group of golf clubs. In this same regard, the control unit 12 may be provided with a switch that would enable a golfer to switch back and forth between a visual alarm and an audible alarm. In some embodiments, display 24 may comprise an LCD display which presents a textual or numeric representation of the missing golf clubs 16. An antenna 26, which in some embodiments may be incorporated into or disposed interior to housing 20, is effective to establish RF communications with RFID tags 18 on golf clubs 16.

Figure 2:
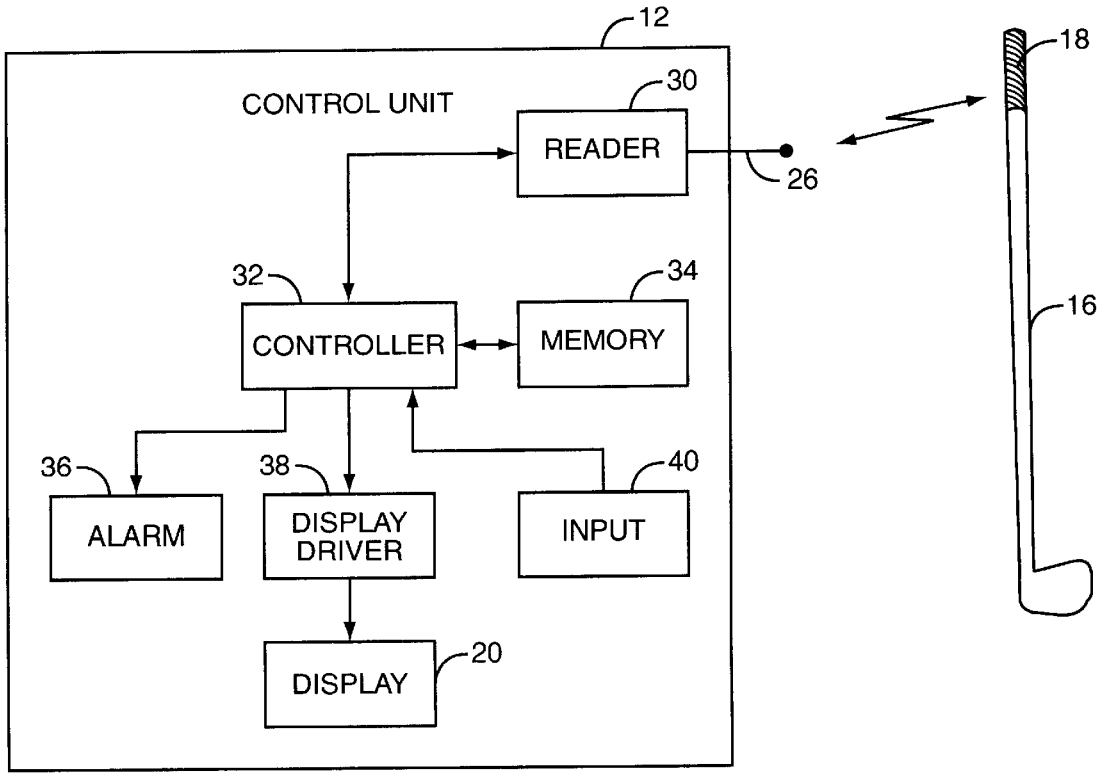
FIG. 2 is a block diagram illustrating the basic components of the golf club monitoring device of the present invention.

Control unit 12 is further shown in schematic form in FIG. 2. RFID reader 30 is connected to antenna 26 and controller 32. RFID reader 30 may also be referred to as a transmitter or transceiver in that the unit is operative to transmit interrogation signals and even receive what is referred to as response signals. Therefore, as used herein, RFID reader 30, transmitter, and transceivers are all used interchangeably. RFID reader 30 contains the electronics and logic necessary to establish RF communications with RFID tags 18. Controller 32, which may be a microprocessor, microcontroller, or the like, is operative to control all aspects of control unit 12. Controller 32 is connected to memory 34, which may comprise RAM, ROM, EEPROM, or the like, as are well known in the art. Memory 34 may contain control software to be executed by the controller 32, and additionally stores a reference inventory, or initial list, of golf clubs 16 present in the golf bag 14 win the control unit 12 is initially turned on. Controller 32 is connected to alarm 36, which may be visual, such as visual indicator 22, or audible, such as a speaker or buzzer. Controller 32 is also connected to display driver 38, which contains the electronics and logic necessary to operatively drive display 20. Controller 32 is also connected to input 40, which may comprise switches to enable or disable various aspects of the alarm 36, and may contain a reset button, or the like.

The RFID reader 30, under the control of controller 32, communicates with RFID tags 18 affixed to golf clubs 16 to periodically perform an inventory of a set or group of golf clubs 16 within its effective range. This range is designed and configured so as to include the golf clubs 16 within the golf bag 14, or those in close proximity thereto. Upon initial power up, or alternatively under the direction of the user such as through the use of the reset button of input 40, the control unit 12 causes the RFID reader 30 to perform an initial inventory of the golf clubs 16 in the golf bag 14. At this point, all golf clubs 16 are located in the golf bag 14, and are hence included in the initial inventory. This initial inventory is retained in memory 34. Periodically thereafter, the controller 32 will direct the RFID reader 30 to perform a subsequent inventory of the golf clubs 16 in the golf bag 14. The result of this inventory is compared to the initial inventory, and retrieved from memory 34, and a determination is made whether any of the golf clubs 16 are missing from the golf bag 14. Additionally, if one or more clubs are missing, they are identified. Upon the determination that one or more golf clubs 16 are missing from the golf bag 14, the controller 32 may alert the user to this fact in a variety of ways.

The controller 32 may, for example, cause the visual indicator 22 to flash. The visual indicator 22 would continue to flash until such time as all golf clubs 16 were returned to the golf bag 14, and the control unit 12 has performed another inventory and determined that all clubs were present, at which time the visual indicator 22 would be turned off. Similarly, the controller 32 could trigger an audible alarm, or take some other action. Additionally, since the control unit 12 not only detects missing golf clubs 16, but identifies them, information about the missing golf clubs 16 could be displayed on display 20. The actions taken upon the discovery of missing golf clubs 16 may be programmed, or alternatively may be dynamically selected and changed by the user through input 40.

The RFID reader 30 may communicate with RFID tags 18 affixed to golf clubs 16 in a variety of ways. For example, the RFID reader 30 could generate an interrogation signal and direct such to each RFID tags 18 on a separate RF frequency, with each RFID tags 18 pre-programmed or otherwise configured to respond (produce a response signal) to a unique frequency.

Alternatively, the RFID reader 30 may output a single frequency RF signal, with each RFID tags 18, via a response signal, responding by communicating a unique identification code. In this configuration, RFID reader 30 could generate an RF sine wave that provides power to the RFID tags 18, a synchronized clock source to the RFID tags 18, and functions as a carrier for returned data from RFID tags 18. In this embodiment each RFID tags 18 contains a coil antenna. The time-varying magnetic field of the electromagnetic output of RFID reader 30 induces an AC voltage in the coil antenna of RFID tag 18. This voltage is rectified by electronics in the RFID tag 18, and powers a silicone memory chip and associated logic. Once the RFID tag 18 has received sufficient energy from its coil antenna to operate correctly, it divides down the RF carriers signal and begins clocking its data to an output transistor connected across the coil antenna. The output transistor shunts the coil sequentially, corresponding to the data being clocked out of the memory array. Shunting the coil causes a momentary fluctuation of the carrier signal, which is detected by the RFID reader 30. In this manner, commonly referred to as "backscatter," each RFID tag 18 communicates its unique identification number or code to the RFID reader or transceiver 30. Such passive RFID systems are well known in the art. For further explanation, one is directed to "Passive RFID Basics" by Pete Sorrells, publication DS00618A of Microchip Technology Inc., the disclosure of which is incorporated herein in its entirety.

For the RFID reader 30 to be able to detect and identify a plurality of RFID tags 18 simultaneously located within in its range, the RFID reader 30 and each RFID tag 18 must cooperate in an anticollision algorithm. One such anticollision algorithm is described in "Contactless Programmable Passive RFID Device with Anticollision," publication DS21267C, and "FSK Anticollision Reader Reference Design," publication DS51167B of Microchip Technology Inc., the disclosures of which are incorporated herein in their entirety. In general, the RFID reader 30 will detect a collision condition, i.e., more than one RFID tag 18 responding at the same time, and will in response issue a "gap" in the RF interrogation signal. A gap is a brief, e.g., 60 microsecond, interruption in the RF signal. Upon detecting the gap, each RFID tag 18 delays further output by a time period that is derived from its interval, unique identification code. Hence, each of the RFID tags 18 will resume output of their identification code at a different time, thereby avoiding collisions. Additionally, upon successfully receiving the identification code of each RFID tag 18, the RFID reader 30 will indicate, e.g., through a transmission gap timed to occur at a specific point in the identification code transmission, that the RFID tag 18 is to cease transmission of its identification code, thus preventing it from interfering with the transmission of subsequent RFID tags 18.

Figure 3:
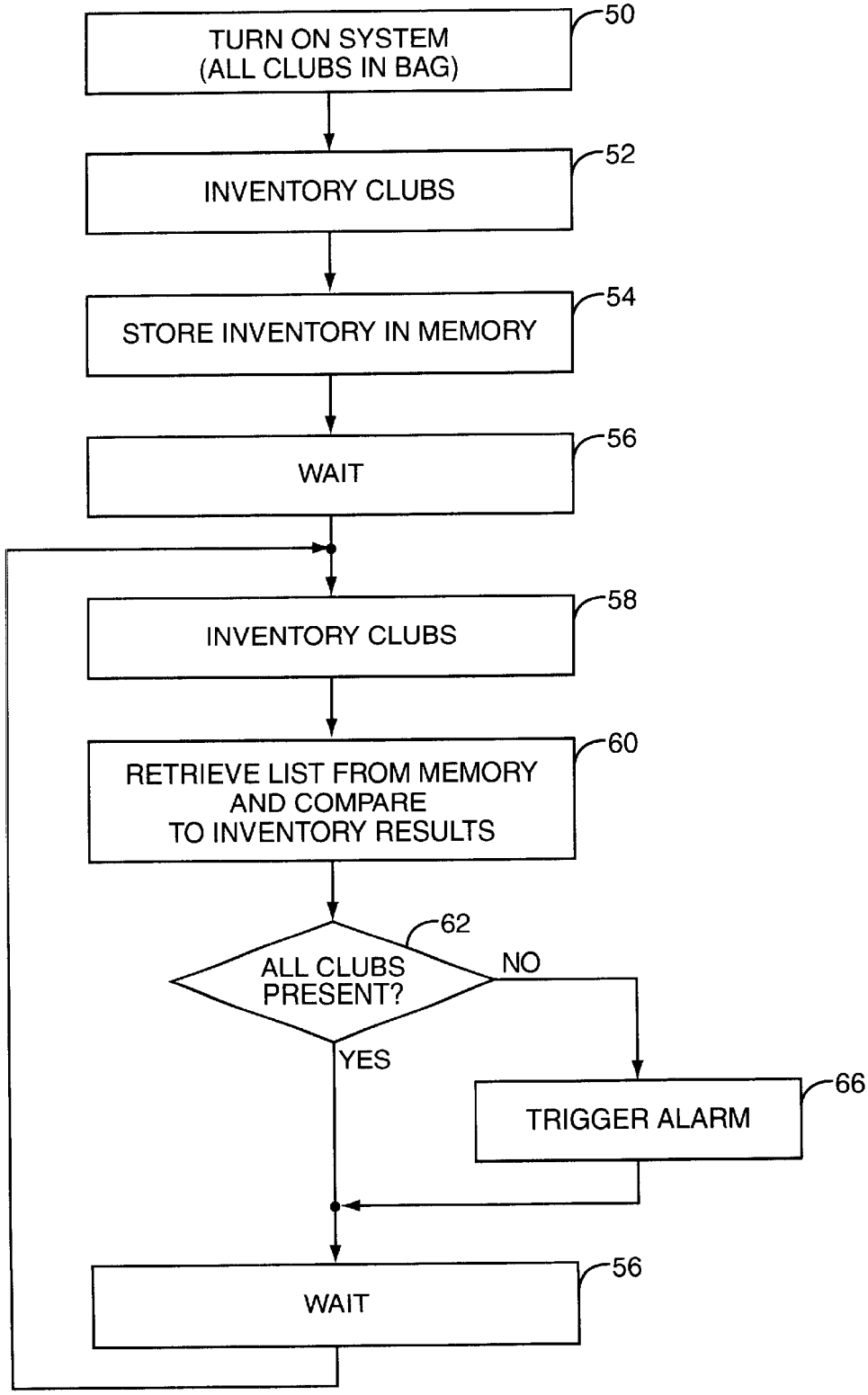
FIG. 3 is a flow chart illustrating the basic steps involved in monitoring a group of golf clubs to determine if one or more of a pre-determined set or group are missing.
Figure 4:
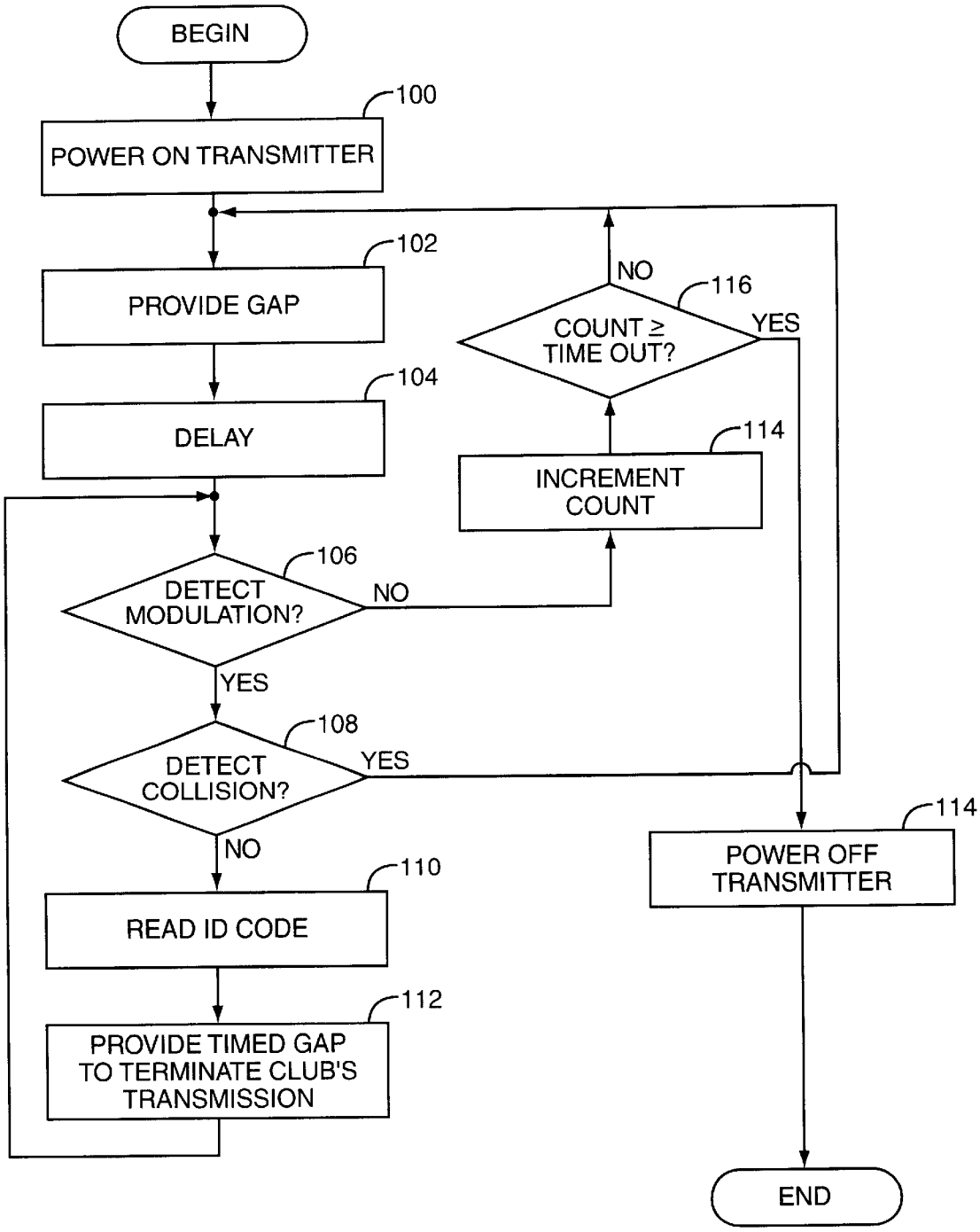
FIG. 4 is a flow chart illustrating the steps involved in inventorying the golf clubs and determining if one or more clubs are missing.

FIGS. 3 and 4 depict, in flowchart form, the process of golf club tracking according to the present invention. Referring to FIG. 3, the user turns on the control unit 12 when all of the golf clubs 16 that he wishes to track are contained in golf bag 14 (step 50). Control unit 12 then performs an initial inventory of golf clubs 16 (step 52). The process of inventorying the golf clubs 16 in the golf bag 14 is described in greater detail below. Once the initial inventory of golf clubs 16 has been obtained, it is stored in memory 34 (step 54) for future reference. The control unit 12 then waits for some predetermined amount of time (step 56) before proceeding. This is primarily to conserve battery power. At the expiration of the waiting period, another inventory of golf clubs 16 contained in the golf bag 14 is performed (step 58). At this point, the initial inventory is retrieved from the memory 34 and compared to the latest inventory (step 60), and a determination is made whether all of the golf clubs 16 are present (step 62). If so, the control unit 12 waits for another predetermined amount of time (step 64), and then performs another inventory (step 58). If one or more golf clubs 16 are determined to be missing from golf bag 14, and alarm is triggered (step 66). The system then waits, and again proceeds with another inventory (step 58). Thus, when the missing golf clubs 16 are returned to the golf bag 14, the alarm will turn off as soon as another inventory is performed.

As discussed above, since a plurality of golf clubs 16 and their associated RFID tags 18 are simultaneously within the field of the RF signal generated by control unit 12 when they are in the golf bag 14, some means of anticollision discrimination is necessary when performing an inventory of the golf clubs 16. Referring to FIG. 4, an inventory begins by powering on the RFID reader 30 and transmitting an RF carrier signal (step 100). Control unit 12 includes an RFID reader 30 which is sometimes referred to herein as a transmitter or transceiver. The RF carrier signal emitted by the RFID reader or transceiver 30 will actuate the RFID tags 18. This will allow the RFID tags 18 to power up and begin transmitting their identification codes. RFID reader 30 then issues a transmission gap to initiate the anticollision algorithms in the RFID tags 18 (step 102). RFID reader 30 waits for a predetermined delay period (step 104) and then detects any backscatter modulation on its RF carrier signal (step 106). If backscatter modulation is detected, indicating at least one RFID tag 18 is responding, then RFID reader 30 examines the modulation to detect a collision or indication that more than one RFID tag 18 is communicating simultaneously (step 108). If a collision is detected, the RFID reader 30 broadcasts another transmission gap to force the RFID tags 18 into their anticollision algorithms. If no collision is detected, the identification code of the responding RFID tag 18 is read (step 110). As of that RFID tag 18 begins to cycle through its identification code again, the RFID reader 30 terminates its backscatter transmission by broadcasting a transmission gap in the RF carrier signal at a particular time in the identification code sequence (step 112). This indicates to that RFID tag 18 to cease backscatter transmission of its identification code, and clears the way for subsequent RFID tags 18 to respond. The RFID reader 30 then proceeds, following a waiting period (step 104) to search for backscatter modulation from another RFID tag 18 (step 106). If no backscatter modulation is detected, the RFID reader 30 increments a counter (step 114). The value of the counter, which represents a time delay, is compared to a predetermined time-out value (step 116). If the time-out duration has not been reached, the RFID reader 30 re-initiates anticollision algorithms by broadcasting a transmission gap (step 102) and proceeds to detect backscatter modulation from another RFID tag 18 (step 106). If, however, the time-out period has been reached or exceeded, the RFID reader 30 determines that no undetected RFID tags 18 remain, and exits the inventory process by turning off the RF carrier signal (step 118). This has the effect of removing power from the RFID tags 18, thus clearing their state from that set by the anticollision algorithm. Hence, wherein the RF carrier signal is again broadcast, each RFID tag 18 will respond from its reset state, causing collisions if more than one golf club 16 is present, and forcing the RFID reader 30 to initiate the anticollision process anew upon in its next inventory.

While the above process has been described with respect to one particular embodiment of the present invention, this embodiment is illustrative and not limiting. A variety of RFID tag anticollision systems exist, and would fall within the scope and spirit of the present invention.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A system for detecting one or more missing golf clubs from a group of golf clubs comprising:

a) a sensor associated with each golf club of the group of golf clubs;

b) an interrogator having a limited operating range and operative to direct signals throughout the limited range, wherein the sensors within the limited range respond to said signals by transmitting a unique identifier, and wherein a golf club is deemed to be missing when the golf club lies outside the limited range and thus its associated sensor fails to respond to said signals;

c) a memory operative to store one or more identifiers transmitted by one or more said sensors, and d) a controller operative to perform an initial inventory of said group of golf clubs, store said initial inventory in said memory, periodically perform subsequent inventories of said group of golf clubs, and to compare said subsequent inventories to said initial inventory, for the purpose of uniquely identifying the golf clubs missing from said group.

2. The system of claim 1 including a series of sensor with each sensor being adapted to be secured to one of the golf clubs of the group of golf clubs; and wherein the interrogator includes a transceiver for transmitting a series of signals with each signal being uniquely coded to register with one sensor.

3. The system of claim 2 wherein the registering of a signal with a sensor results in a responsive signal being produced that is transmitted back to the transceiver.

4. The system of claim 1 wherein the interrogator includes a transceiver for transmitting at least one signal that is operative to register with each sensor and upon registration each sensor generates a response signal that uniquely identifies the golf club associated therewith.

5. A method of detecting and identifying one or more missing golf clubs from a group of golf clubs comprising:

directing at least one signal towards the group of golf clubs wherein the signal is adapted to detect and identify at least one golf club of the group;

forming an inventory of detected and identified golf clubs; and determining if one or more of the golf clubs of the group is undetected by the at least one signal by comparing the detected and identified golf clubs to a previously determined inventory of golf clubs defining said group.

6. The method of claim 5 including directing a series of signals towards the group of golf clubs wherein each signal is adapted to detect at least one golf club of the group.

7. The method of claim 6 further including placing a sensor on each golf club of the group and wherein respective signals are uniquely coded to register with one sensor, and wherein the failure of a particular signal to register with a sensor indicates a missing golf club.

8. The method of claim 7 wherein the signals are directed from a transceiver and wherein the registering of a signal with a sensor results in a response signal emanating from the sensor back to the transceiver, and wherein the transceiver is operatively coupled to a controller that includes logic that determines whether one or more of the golf clubs of the group are missing based on the response signals from the sensors.

9. The method of claim 8 including actuating an alarm in response to a determination that one or more clubs of the group are missing.

10. The method of claim 9 wherein the alarm is a visual alarm.

11. The method of claim 9 wherein the alarm is an audible alarm.

12. The method of claim 11, wherein said visual alarm includes an indicia that uniquely identifies the missing club to the user.

13. The method of claim 5 including the step of inventorying the golf clubs of the group to establish the number and identity of golf clubs in the group and thereafter checking the inventory for missing clubs by seeking to detect and identify each golf club of the group.

14. A system for detecting one or more missing golf clubs from a group of golf clubs comprising:

a) a series of sensor tags with each sensor tag being secured to one golf club of the group;

b) a transceiver for emitting at least one signal that is operative to actuate at least one sensor resulting in a response signal being produced that detects and identifies the golf club associated with that sensor tag; and c) a controller operatively connected to the transceiver and operative to inventory a group of golf clubs and to subsequently determine if all of the golf clubs of the group are present based on the response signals produced by the sensor tags.

15. The system of claim 14 wherein the sensor tags include a series of RFID tags and wherein the signal emitted by the transceiver is an RF signal that actuates at least one RFID tag resulting in the RFID tag producing a response signal that is operative to identify the golf club associated with the RFID tag.

16. The system of claim 14 further including a controller operatively connected to the transceiver and wherein the controller is operative to receive date from the transceiver and to account for golf clubs of the group based on the response signal.

17. The system of claim 16 wherein the controller is operative to inventory a group of golf clubs and to effectively count the number of golf clubs constituting the group and then to determine if all of the golf clubs of the group are present based on the response signals produced by the sensor tags.

18. A method for detecting one or more missing golf clubs from a group of golf clubs comprising:

a) initially inventorying the golf clubs in the group via a radio frequency transmission, whereby each golf club responsively transmits a unique identifier;

b) storing the unique identifier received from each golf club in a memory;

c) periodically re-inventorying the group of golf clubs via radio frequency transmission;

d) comparing the unique identity received from each golf club during the re-inventory to the identities previously stored in memory, to determine if any golf clubs from the group are missing; and e) outputting an alert if one or more golf clubs are missing from the group.

* * * * *